United States Patent [19]

Fish, Sr.

[11] 3,971,095

[45] July 27, 1976

[54] REMOTELY CONTROLLED COLLAPSIBLE DUST PAN

[76] Inventor: Paul R. Fish, Sr., P.O. Box 82, Port Deposit, Md. 21904

[22] Filed: Oct. 11, 1974

[21] Appl. No.: 514,242

Related U.S. Application Data

[63] Continuation-in-part of Ser. No. 391,324, Aug. 28, 1973, abandoned.

[52] U.S. Cl. ..... 15/257.7; 15/144 B

[51] Int. Cl.[2] ..... A47L 13/52

[58] Field of Search ..... 15/104.8, 257.1, 257.2, 15/257.4, 257.6, 257.7, 257.8; 294/53.5; 172/372

[56] References Cited

UNITED STATES PATENTS

| | | | |
|---|---|---|---|
| 341,160 | 5/1886 | Myers | 294/53.5 |
| 357,408 | 2/1887 | Pittenger | 294/53.5 |
| 676,424 | 6/1901 | Depew | 15/257.7 |
| 946,109 | 1/1910 | Chamberlain | 15/257.7 |
| 958,255 | 5/1910 | Koertner | 15/257.7 |
| 959,926 | 5/1910 | Feld et al. | 15/257.7 |
| 1,191,945 | 7/1916 | Carlson | 15/257.7 |
| 1,741,004 | 12/1929 | Wornstaff | 294/53.5 |
| 2,015,517 | 9/1935 | Fransson | 294/53.5 X |
| 2,978,731 | 4/1961 | Belluomini | 15/257.7 X |
| 3,562,840 | 2/1971 | Meszaros | 15/257.4 |

*Primary Examiner*—Daniel Blum
*Attorney, Agent, or Firm*—Robert Jacobs

[57] ABSTRACT

A collapsible dust pan is disclosed wherein the user has the ability by a remote control means to keep the dust pan in a lowered position or to raise the dust pan and hold it in an upright position for storage. The dust pan is a hinged pan so that the pan itself can be folded against the upright portion of the handle for easy storage.

2 Claims, 3 Drawing Figures

REMOTELY CONTROLLED COLLAPSIBLE DUST PAN

This application is a contiuation-in-part of an application filed by the applicant known as Ser. No. 391,324, filed Aug. 28, 1973, now abandoned, and entitled "Folding Dust Pan."

This invention relates to a collapsible, remotely controlled dust pan. More particularly, this invention relates to a dust pan wherein the pan member is so disposed as to fold for storage and the folding and unfolding mechanism and engaging means for both the up and down positions are controlled remotely from the pan.

Although dust pans with a folding member for a pan have been disclosed in the art, to-wit: U.S. Pat. Nos. 946,109; and 1,191,945, it has long been felt that the necessity for bending to accomplish the up and down movement of the dust pan hindered the usefulness of these pans and that the height of said dust pans was not conducive to adequate industrial usage.

It is an object of this invention to provide a remotely controlled folding dust pan.

It is another object of this invention to provide an adjustable handle on a dust pan.

Still other objects will become evident to those skilled in the art upon reading this disclosure.

Figure 1:
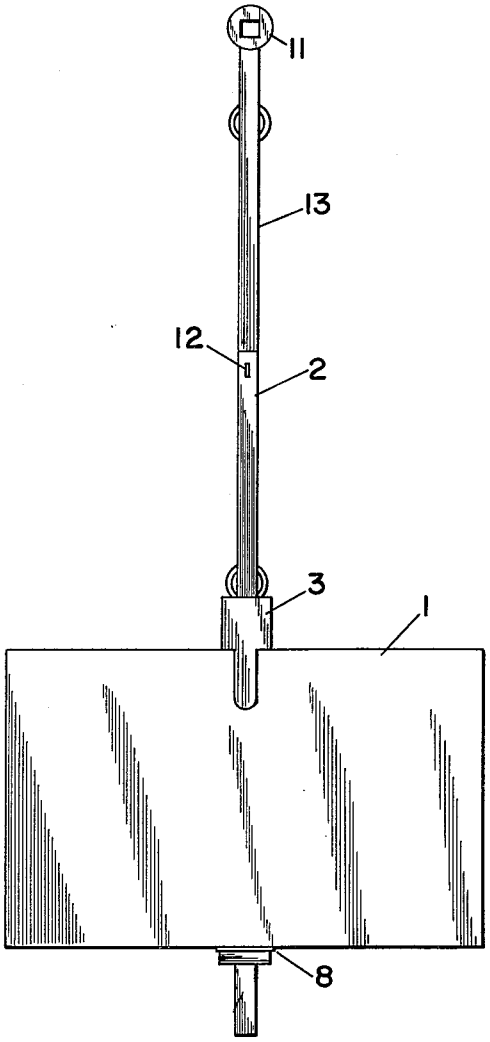

FIG. 1 is a front view of the invention showing the pan, item 1, with a back, side and bottom, in an upright position and engaged by a non-spring locking means, item 3, and showing the handle, item 11, which is used and aids in control of the dust pan.

Figure 2:
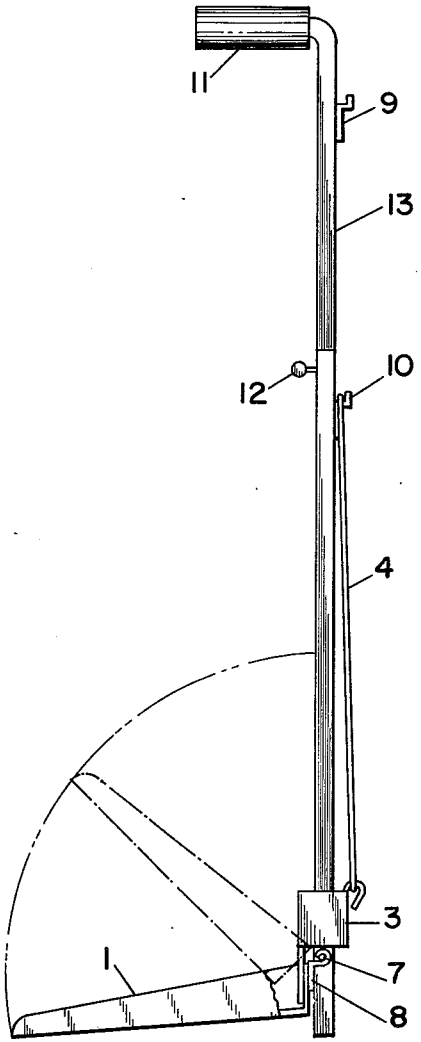

FIG. 2 is a side view of the dust pan showing the pan in open position indicating that item 2, the upright member, is a stop for the pan, retarding its movement on rotation below the horizontal position and also showing that the front edge of the pan is level with the bottom edge of the upright member when it is open. FIG. 2 also shows the swing of the pan around a hinge, items 7 and 8.

Figure 3:
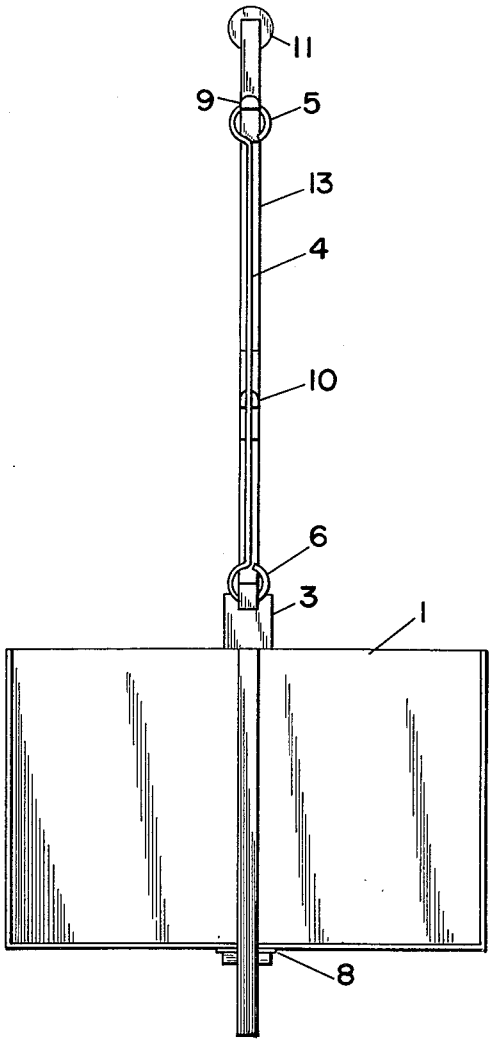

FIG. 3 is a rear view of the dust pan in a closed position.

The parts of the invention are: item 1, the pan; item 2, the upright member; items 3,4,5, and 6, the remote-control means for engaging the pan in its open and closed positions; items 7 and 8, the hinge means for accomplishing the folding of the pan; items 9 and 10, latch means for the remote-control means; item 11, is a holding means such as a handle wherein it is formed perpendicular to the upright member and facing in the same direction and parallel to the pan when it is in the open position; item 12, an adjusting screw; and item 13, a telescoping member.

In general, the concept of this invention is a dust pan wherein the geometric configuration of the pan is material except that a portion of the pan in closest proximity to the handle must be nearly perpendicular in an upright fashion with respect to the bowl of the pan and, in addition, must be sufficiently thin to be engaged by the engaging means of the remote-control means 3. Also, the pan must be so formed that its front lip is open to allow receipt of dust and material swept on to it and the sides must be able to contain such dust and debris. The width of said pan as shown in FIG. 1 is usually less than 18 inches. The pan is connected to the upright member 2, by a hinged means 7 and 8. In the configuration shown in FIGS. 1 through 3, the hinged means comprises a split flat hinge, which is intimately connected to the pan and connected by a pin 7, to the upright member. The folding or bending of the hinge is around said pin.

As is clearly indicated in the drawings, the simplicity of the design, shown in FIGS. 1,2 and 3, requires no spring nor ratchet mechanism for the opening or closing or engaging of the dust pan in an upright or closed position. The upright member serves a multiple function. First, it is a support for the dust pan and enables the user to, without stooping, hold the pan in a useable position. In addition, the bottom portion of said upright member, in relation to items 7 and 8, the hinge mechanism, is suficiently long to prevent the dust pan from being lowered below the necessary horizontal position for sweeping use. Also, the upright member extends sufficiently below the hinge to act as a back brace so that the pan member and the bottom of the upright member only touch the floor for ease of use. As indicated, due to the solid construction of the upright member, item 3 easily rides up and down without any spring mechanism required and engages the pan in both the horizontal and vertical positions without any undue strain on the user. As shown in FIGS. 2 and 3, the pan has only two positions which are possible, the open position whereby it is used for scooping up the dust, and the closed position. An intricate part of this concept is that in both positions the same non-spring uncomplicated flat engaging mechanism, item 3, is utilized.

The control means, item 4, is easily utilized to lift latch 3 and open and close the dust pan without stooping or bending. In addition, as shown in the FIGS., the handle, item 11, is at a 90° horizontal configuration to the upright member, allowing one to better grasp the dust pan when using it without the possibility of slipping. In addition, it gives obvious leverage in keeping the pan flat without hurting one's hand as opposed to a cane or knob type upright member ending.

The upright member may be made out of a solid or hollow shaft material such as tubular steel, solid iron bar, aluminum brass, copper, bronze, plastic or any material of construction which has rigidity and sufficient strength to allow one to place it on the floor and keep the pan flush with the ground being swept. In general, the height of the tubular rod will vary from two and a half to four feet and an alternative upright member would be telescoping so that it may be opened or closed within these heights. The dust pan shown in FIGS. 1 through 3 has a telescoping upright member 13, can slide within Item 2 and be adjusted to a position by tightening or loosening a wing nut 12. The cross section of the upright member is not critical but will in general be less than 2 inches square.

The remote-control means shown in FIGS. 1 through 3 comprises a guide wire 4; a hooking member 5; and a connecting rigid latch member 3, secured to said guide wire by a ring 6. In operation, the guide wire is pulled upwardly by the user releasing the latched pan and allowing the pan to be lowered by gravity into a horizontal position. The guide wire is then pushed down by the user engaging the latch against the back portion of the pan and then the hooking means is connected to Item 10, a securing nodule, and the pan is in a use position. The reverse of this technique is then utilized for folding the pan, that is, the guide wire is pulled upwardly releasing the rigid latch and the rigid latch is raised above the point of the upright member where the front end of the pan touches the upright member upon folding. The pan is then folded with a motion of the foot and the latch is allowed to engage the front edge of the pan in the upright position locking the pan into place. The hooking means is then connected to upper locking nodule restraining it and securing the guiding wire. Item 8, one portion of the hinge as shown in FIG. 2, comes into contact with the upright member, and extended portions thereof, which prevents the pan from swinging below the horizontal in the open position. Thus the upright member and the hinge work as a stop mechanism as illustrated in FIG. 2.

Although in this configuration the guide wire is shown as an external item it is contemplated that the guide wire can and should be placed within a hollow tubular upright member thereby securing it from damage by protection of the tubular bar. In this configuration the latch means would still ride along the exterior portion of the upright member but would be connected through a channel to a guide wire for raising or lowering the latch means.

As indicated above, a telescoping portion of the upright member is contemplated. Thus the upper foot and a half of the upright member will be able to be lowered within the bottom two and a half feet, being secured by a locking means such as a lock screw or wing nut at the height at which the user is most comfortable in holding the dust pan. Regardless of the position of the member, the guide wire and latching mechanism described above will be utilized to enable remote control of the position of the dust pan.

The materials of construction of the dust pan, although not critical, would be preferably light materials and therefore tubular steel, aluminum or brass upright members are preferred as well as strong, rigid plastic such as reinforced fiberglass epoxy structures. The pan can also be metal or reinforced plastics and the guide wire should be either metal or sturdy synthetic fibers such as nylon or polyesters. The latching means and the nodules are also metal or plastic.

With respect to the gripping means at the top of the upright member 11, the configuration shown in FIGS. 1 through 3 is the preferred configuration whereby the upright means has a 90° angle forming a gripping handle. However, other handles, including a cane type knob handle would be considered within the scope of this invention so long as the handle 11 extends in the same direction as the pan in its open position as shown in the figures.

Having described my invention, I now claim the following:

1. A collapsible dust pan combination consisting of an upright member with a holding means located at the upper end of said upright member extending at substantially a 90° angle with respect to said upright member; a pan having a back, sides and bottom connected to the lower portion of said upright member through a hinge, said holding means extends in the same direction as said pan when said pan is in an open position; a rigid latch for engaging said pan in a horizontal position by engaging the back of said pan, said pan folding up and leaning against said upright member in a closed position being retained therein by the rigid latch engaging the front edge of the pan and said pan opening to the horizontal position and being stopped at said horizontal position by said hinge means coming into contact with an extension of a lower portion of the upright member preventing the pan from going beyond the horizontal position, said upright member containing a remotely operated control means disposed near the top of said upright member for controlling the rigid latch so that said pan can be released from its closed position and engaged in its open position without stooping by using the control means located near the top of said upright member, wherein said upright member is a shaft.

2. A dustpan combination in accordance with claim 1 wherein said upright member is a hollow tubular, rigid member, said dust pan being hinged by a pin hinge wherein one portion of the hinge is fastened to the pan and another portion is fastened to the upright member, with the pin connecting the two members allowing free movement around it; said rigid latch is connected to a guide wire which extends longitudinally of the upright member for a substantial distance placing the control of said latch within the grasp of the user of the dust pan, thus the user controls the engagement of the latch in the closed or open position of the pan from the top of the upright member.

* * * * *